US005496087A

United States Patent [19]

Lathrop

[11] Patent Number: 5,496,087

[45] Date of Patent: Mar. 5, 1996

[54] SUPPORT DEVICE FOR BAGS

[76] Inventor: Judith Lathrop, 151 Rivergate Dr., Wilton, Conn. 06897

[21] Appl. No.: 192,340

[22] Filed: Feb. 7, 1994

[51] Int. Cl.[6] ..... B65D 33/06

[52] U.S. Cl. ..... 294/137; 248/95

[58] Field of Search ..... 294/1.1, 1.3, 137, 294/142, 143, 145, 170, 172; 53/381.1, 384.1, 390; 141/108, 109, 316, 390, 391; 206/554; 248/95, 97, 99–101; 383/6, 9, 13, 22–26, 33, 35; D9/434, 455

[56] References Cited

U.S. PATENT DOCUMENTS

| | | | |
|---|---|---|---|
| D. 137,712 | 4/1944 | Miano | 294/170 X |
| D. 216,062 | 11/1969 | Domingo | 383/13 X |
| D. 340,863 | 11/1993 | Daigle | 294/137 X |
| 1,567,677 | 12/1925 | Ricketts | 248/99 X |
| 1,675,439 | 7/1928 | Wolf | 383/13 X |
| 4,638,968 | 1/1987 | Auten | 248/97 |
| 4,749,011 | 6/1988 | Rylander | 294/1.1 X |
| 4,921,193 | 5/1990 | Benesch | 248/97 |
| 4,981,216 | 1/1991 | Wilfong | 383/9 X |

*Primary Examiner*—Johnny D. Cherry

[57] ABSTRACT

A support device for bags comprises an integral, closed U—shaped planar body having at the top two symmetrical recesses to receive bag hanger elements, the sides of the recesses forming a handle element in the middle and two support elements at both ends. The support device may be formed of wood, plastic or wire.

5 Claims, 2 Drawing Sheets

SUPPORT DEVICE FOR BAGS

BACKGROUND OF THE INVENTION

The present invention relates to a support device for bags and receptacles and, more particularly, to a support device which permits suspension thereof for storage and transportation of bags.

One of the environmental concerns is waste. Reduction of waste concerns everyone, including the consumer who can effectively participate by recycling. The recycling process can begin with plastic bags used to carry purchases from supermarkets, stores, shops and the like.

The storage and transport of recyclable bags presents a number of problems. Plastic bags tend to lose their shape and aesthetic appeal because they crush, wrinkle, form unsightly piles and are difficult to separate, organize and smooth out for reuse. The present invention provides a support device which facilitates storage and recycling of plastic bags with ease.

SUMMARY OF THE INVENTION

In accordance with the invention, a support device for bags is provided which comprises an integral planar body in the shape of a U interconnected end to end to form a closed top plane having two symmetrical perimetric recesses to receive bag hanger elements, one side of the recesses forming a handle element in the middle and the other side of the recesses together with the top part of the U shape forming two support elements and wherein said handle element has an open space therein.

Another embodiment of the invention provides a support device for bags comprising a planar body in the shape of a U interconnected end to end to form a closed peripheral body having an open space and at the top two symmetrical perimetric recesses to receive bag hanger elements, one side of the recesses forming a handle element in the middle and the other side of the recesses together with the upper part of the U shaped body forming two support elements.

DETAILED DESCRIPTION OF THE INVENTION

Figure 1:
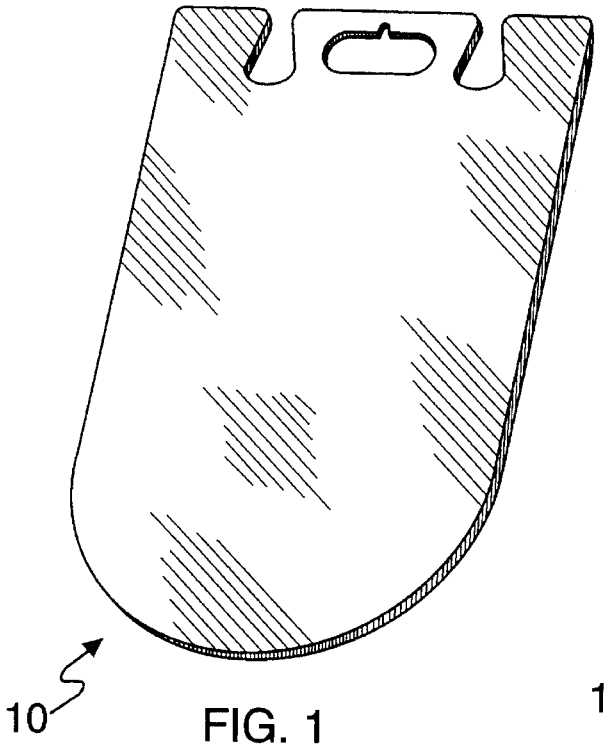
FIG. 1 is an isolated perspective plan view of the bag support device.
Figure 2:
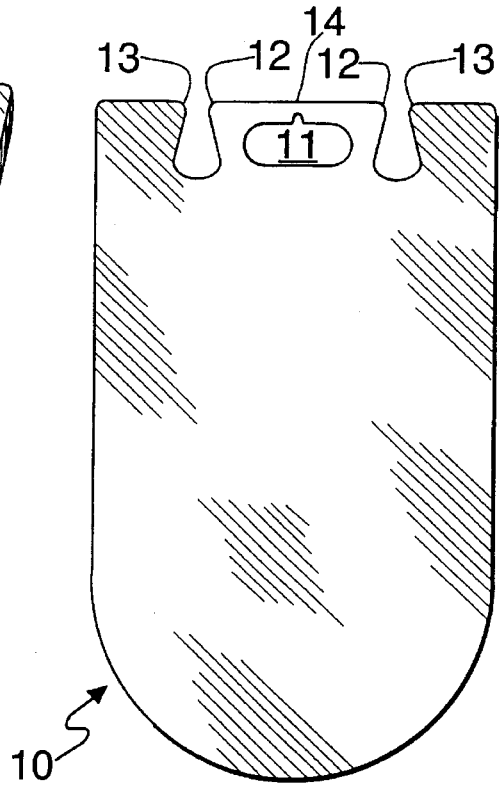
FIG. 2 is a front plan view of the support device.
Figure 3:
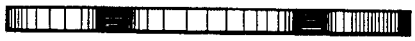
FIG. 3 is a top plan view of the device.
Figure 4:
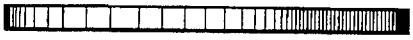
FIG. 4 is a bottom plan view of the device.
Figure 5:
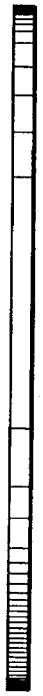
FIG. 5 and FIG. 6 are side plan views of the device.
Figure 6:
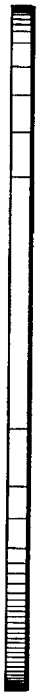

The drawings, and in particular FIG. 1 and FIG. 2, show a support device (10) that forms the basis of the present invention.

In FIG. 2, the preferred embodiment of the support device is seen and understood to comprise an integrally formed, substantially planar body in the shape of a U interconnected end to end to form a closed configuration with an open space (11). The top edge has two symmetrical perimetric recesses; one side (12) of the recesses form a handle (14) in the middle and the other side (13) of the recesses together with the upper part of the U-shaped body form two supports. The handle (14) may serve as a carrying element or as a hanging element. When used as a hand grip for carrying, the opening (11) is preferably at least six centimeters long horizontally and about two to three centimeters wide vertically. The recesses serve as mounts for bag hanging elements. The recesses may have sides that are slanted or perpendicular.

The device (10) can be formed of wood or plastic. A plastic device may be formed of any extrudable or moldable polymeric composition by known processing methods. Exemplary polymers include, among others, polyvinyl chloride, polypropylene and polyurethane.

Figure 7:
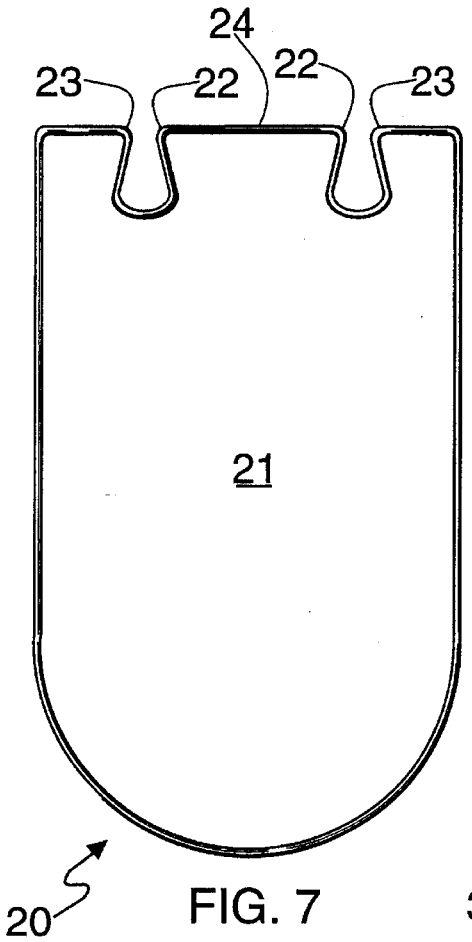
FIG. 7 is a front plan view of an alternate version of the preferred embodiment.

FIG. 7 shows an alternate embodiment of the support device (20). The periphery of the device is formed in the shape of a U closed end to end to form a closed body having an open space (21). The top edge contains two symmetrical recessions. The edges (22) of the two recessions define a handle element (24) in the middle and the other edges (23) of the two recessions together with the upper part of the U-shaped body define the support elements.

Since the body structure is open, the device is preferably formed from wire, rattan or similar material.

The size of the support device will depend on the bag size contemplated to be used. It will be sufficiently smaller to allow insertion into an optimum number of bags stored.

Figure 8:
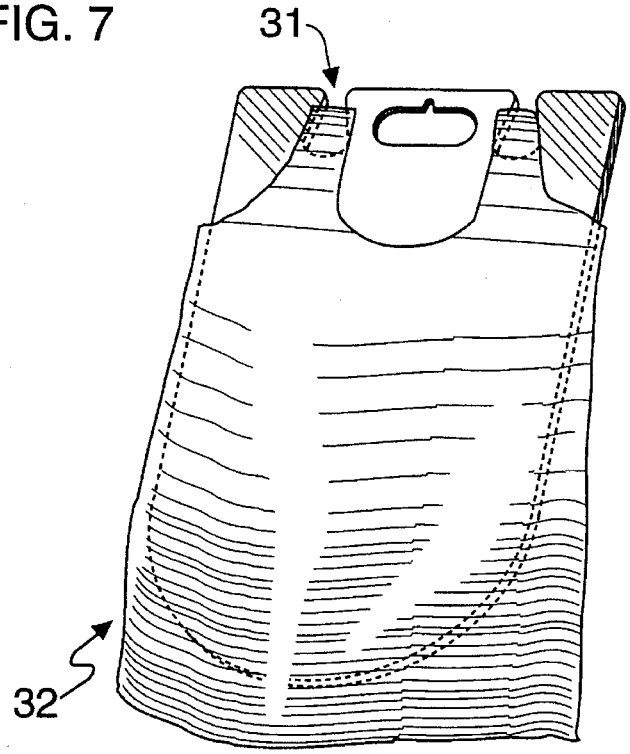
FIG. 8 is an isolated perspective plan view of the support device with a bag.

FIG. 8 illustrates the manner of usage of the support device. The recesses (31) permit the bags (32) to be suspended on the device. The U shape of the device expands the bag and holds it in shape. The bags can be mounted on the device by their handles, drawstrings or similar elements which can serve for mounting on the support device. The bags can be mounted on the support device by placing the device inside the bag. Alternately, the bag can be pulled over the U shaped portion of the support device and the bag handles inserted into the recesses. The device can support a multiple number of bags placed inside each other.

The support device can be used for plastic as well as paper bags. The bag support is a space saving device on which bags are hung neatly for storage and organized for recycling. In addition to home use, the supported bags can be conveniently carried to a store for reuse. The organized mounting of the bags permits convenient and time-saving handling at the checkout area.

Although this invention has been described in relation to storing and recycling consumer bags and receptacles, it is to be understood that the invention is applicable to other fields. For example, the device can be used for storing large scale bags used in retail and industry.

What is claimed is:

1. A flat support device for used bags comprising an integral planar body in the shape of a U transversed at the top to form a closed edge having two symmetrical perimetric recesses to receive bag hanger elements and a middle portion forming a handle element and wherein said handle element has a handle opening.

2. A support device for used bags comprising a planar body in the shape of a U transversed at the top to form a closed peripheral body having an open space and at the top two symmetrical perimetric recesses to receive bag hanger elements and a middle portion forming a handle element.

3. A flat device to support, carry and store used bags comprising a singular integral unitary planar body substantially elongated and U shaped with two elongated side edges, a rounded bottom portion connected to the side edges and a substantially straight upper edge extending and connected to the continuous side edges and in the upper edge two symmetrical, perimetric, spaced recesses extending downwardly to receive bag hanger elements, formed from the upper edge and an open space between the recesses, adjacent to the upper edge to form a handle or hand holding device.

4. A device according to claim 3 wherein the body is formed of wood.

5. A device according to claim 3 wherein the body is formed of plastic.

* * * * *